US006591559B2

(12) United States Patent
Contreras et al.

(10) Patent No.: US 6,591,559 B2
(45) Date of Patent: Jul. 15, 2003

(54) EXTERIOR WALL SEALING SYSTEM

(76) Inventors: Victor Contreras, 2547 N. 72nd Dr., Phoenix, AZ (US) 85035; Sandra Contreras, 2547 N. 72nd Dr., Phoenix, AZ (US) 85035

( * ) Notice: Subject to any disclaimer, the term of this patent is extended or adjusted under 35 U.S.C. 154(b) by 0 days.

(21) Appl. No.: 09/825,175

(22) Filed: Apr. 3, 2001

(65) Prior Publication Data

US 2002/0139060 A1 Oct. 3, 2002

(51) Int. Cl.[7] ..... E04H 9/16; E04B 1/70; E02D 19/00

(52) U.S. Cl. ..... 52/101; 52/169.5; 52/302.3; 43/1

(58) Field of Search ..... 52/101, 4, 169.5, 52/302.3; 43/1

(56) References Cited

U.S. PATENT DOCUMENTS 2,176,598 A * 10/1939 Tennison
2,720,051 A * 10/1955 Line
2,905,072 A * 9/1959 Oswald
3,879,255 A * 4/1975 Mason et al. ..... 156/527
5,218,793 A * 6/1993 Ball ..... 52/169.5
5,630,297 A * 5/1997 Rutherford
5,802,779 A * 9/1998 Hulls et al. ..... 43/124
5,904,007 A * 5/1999 Trapnell
5,979,123 A * 11/1999 Brockman
6,119,429 A * 9/2000 Bifano et al. ..... 52/101
6,134,847 A * 10/2000 Bifano et al.
6,263,623 B1 * 7/2001 Weiss et al. ..... 49/463
6,298,609 B1 * 10/2001 Bifano et al. ..... 52/101
6,298,610 B2 * 10/2001 Traxler ..... 52/101
6,453,628 B2 * 9/2002 Traxler ..... 52/169.14

* cited by examiner

*Primary Examiner*—Carl D. Friedman
*Assistant Examiner*—Kevin McDermott
(74) *Attorney, Agent, or Firm*—Martin L. Stoneman

(57) ABSTRACT

A system for sealing the gaps that occur along the perimeter of a building envelope, particularly along with installation of an exterior finish system channel, or screed, as occurs in the installation and application of stucco. It is common to have gaps occur between the channel, base plate, and foundation of the building envelope. The system utilizes a foam sealing element in combination with the channel, caulking, a fiberglass netting that is installed along the bottom of the channel and the face of the foundation, and, an adhesive sealant that seals and adheres the fiberglass netting to the foundation. The system includes several embodiments for use in either new construction or as an aftermarket product.

20 Claims, 4 Drawing Sheets

EXTERIOR WALL SEALING SYSTEM

BACKGROUND

This invention relates to providing a system for sealing the gaps that occur along the perimeter of a building envelope. Typically, constructing walls of buildings may be accomplished by a variety of methods. One such method is to utilize wood or steel framing members to create a framed wall. These framed walls typically consist of framing members with a horizontal top and bottom piece (typically referred to as a top plate and a bottom plate or base plate) and vertical members attached from top plate to bottom plate and placed at intervals of about 16 inches or about 24 inches (typically referred to as studs). The bottom plate is typically attached to a cement or wood foundation. The combination of the dependent walls attached together and the roof create a firm structure. Depending on the type of building and local code, the exterior of the framed walls may be sheathed. The sheathing may be plywood, brick, stucco, vinyl, wood or other exterior finish system. Sheets of gypsum board or drywall are typically attached on the interior of the walls. The sheathing also adds strength to the structure.

When the building is completed, the structure is said to have a building envelope, which includes any component necessary to prevent water or other weather conditions from entering the structure. The building envelope also preferably assists in keeping out insects and other unwanted vermin. When applying an exterior finish system, such as, for example, stucco, foam insulation panels are often attached to the framed wall, and then a layer of stucco is applied to the foam. The exterior finish system is typically set in an accessory channel (which may be herein referred to as a "screed" or "weep screed", "weep" referring to the typical presence of some holes in the screed to permit moisture collecting from above the screed to exit or evaporate) attached along the bottom plate. Insulating panels are typically placed in this channel, and a coating of stucco material is applied over the insulating panels. During the framing process, application of the channel, and application of the stucco, it is common to have gaps occur in the building envelope. These gaps are usually greatest between the channel, base plate, and foundation.

OBJECTS OF THE INVENTION

A primary object and feature of the present invention is to provide a system for sealing the gaps that occur along the perimeter of a building envelope utilizing an exterior finish system and base-plate-attached screed. It is a further object and feature of the present invention to provide such a system which functions in both new and existing construction. A further primary object and feature of the present invention is to provide such a system which is efficient, inexpensive, and handy. Other objects and features of this invention will become apparent with reference to the following descriptions.

SUMMARY OF THE INVENTION

According to a preferred embodiment of the present invention, there is provided a system for blocking vermin from access to a building envelope in the vicinity of a juncture between a foundation and a base plate comprising: a screed, overlaying the base plate, structured and arranged to assist in the fastening of an exterior finish system to an exterior wall of the building; and a blocker structured and arranged to block passage of the vermin between the foundation and such screed; wherein such blocker comprises a foam seal, cooperating with such screed and structured and arranged to prevent vermin passage between such screed and the foundation. It also provides such a system wherein such blocker comprises an adhesive and a thin material layer cooperating to block the passage of the vermin. And, it provides such a system wherein such foam seal comprises a round compressive seal. Further, it provides such a system wherein such screed comprises a planar substantially vertical upper portion; an outward angled portion which protrudes downward and outward from a vertical plane of such substantially vertical upper portion; an inward angled portion which returns downward and inward toward such substantially vertical upper portion until it reaches an approximate intersection with such vertical plane; an inner return outward angle portion which returns upward and outward; and an inner return inward angle portion which extends until it reaches an approximate intersection with such vertical plane; wherein such first and second inner return portions comprise an inwardly facing horizontal crease structured and arranged to support such foam seal.

Moreover, it provides such a system wherein such foam seal further comprises a B-cross-section configuration compressive seal comprising a first longitudinal side with a flat portion, a second longitudinal side with two convex portions, and a center concave portion, wherein such flat portion further comprises an adhesive and a removable release sheet covering such adhesive, wherein such flat portion of such B-cross-section configuration compressive seal is adhesively attached to the back of such planar substantially vertical upper portion of such screed, whereby a caulking bead placed in such center concave portion will assist in sealing such screed when attached to the juncture between the foundation and the base plate. And, it provides such a system wherein such blocker comprises an adhesive and a thin material layer cooperating to block the passage of the vermin. Even further, it provides such a system wherein such foam seal comprises a round compressive seal. Even further, it provides such a system wherein such screed comprises an upper substantially vertical portion; and a lower substantially flat horizontal bottom portion; wherein such upper substantially vertical portion and such lower substantially flat horizontal bottom portion are substantially perpendicular to each other.

It also provides such a system wherein such blocker comprises an adhesive and a thin material layer cooperating to block the passage of the vermin. And, it provides such a system wherein such foam seal comprises a round compressive seal. Also, it provides such a system wherein such foam seal further comprises a two-sided flat compressive seal; and wherein such foam seal cooperates with such adhesive and a thin material layer to block the passage of the vermin between the foundation and such screed. Further, it provides such a system wherein such two-sided flat compressive seal comprises adhesive on at least one side. And, it provides such a system wherein such foam seal further comprises a B-cross-section configuration compressive seal comprising a first longitudinal side with a flat portion, a second longitudinal side with two convex portions, and a center concave portion, wherein such flat portion further comprises an adhesive and a removable release sheet covering such adhesive, and wherein such flat portion of such B-cross-section configuration compressive seal is adhesively attached to the back of such planar substantially vertical upper portion of such screed, whereby a caulking bead placed in such center concave portion will assist in sealing such screed when attached to the juncture between the foundation and the base plate.

Still further, it provides such a system further comprising the foundation; the base plate; the exterior finish system; and at least one exterior wall of the building.

According to another preferred embodiment of the present invention, there is provided a system for blocking vermin from access to a building envelope in the vicinity of a juncture between a foundation and a base plate comprising: a screed, overlaying the base plate, comprising a planar substantially vertical upper portion, an outward angled portion which protrudes downward and outward from a vertical plane of such substantially vertical upper portion, an inward angled portion which returns downward and inward toward such substantially vertical upper portion until it reaches an approximate intersection with such vertical plane, an inner return outward angle portion which returns upward and outward, and an inner return inward angle portion which extends until it reaches an approximate intersection with such vertical plane, wherein such first and second inner return portions comprise an inwardly facing horizontal crease structured and arranged to support a foam seal element; and an adhesive and a thin material layer cooperating to block the passage of the vermin between the foundation and such screed.

It also provides such a system further comprising a foam seal element, cooperating with such screed and such adhesive, and a thin material layer, structured and arranged to prevent vermin passage between such screed and the foundation. And, it provides such a system wherein such foam seal element comprises a round compressive seal.

According to another preferred embodiment of the present invention, there is provided a system for blocking vermin from access to a building envelope in the vicinity of a juncture between a foundation and a base plate comprising: a screed comprising an upper substantially vertical portion, a lower substantially flat horizontal bottom portion, wherein such upper substantially vertical portion and such lower substantially flat horizontal bottom portion are substantially perpendicular to each other; and an adhesive and a thin material layer cooperating to block the passage of the vermin between such screed and the foundation. It also provides such a system further comprising a foam seal element, cooperating with such screed and such adhesive and a thin material, structured and arranged to prevent vermin passage between such screed and the foundation. And, it provides such a system wherein such foam seal element comprises a round compressive seal.

Additionally, it provides such a system further comprising: a foam seal comprising a two-sided flat compressive seal; wherein such foam seal cooperates with such adhesive and a thin material layer to block the passage of the vermin between the foundation and such screed.

DETAILED DESCRIPTION OF A PREFERRED EMBODIMENT OF THE INVENTION

Figure 1:
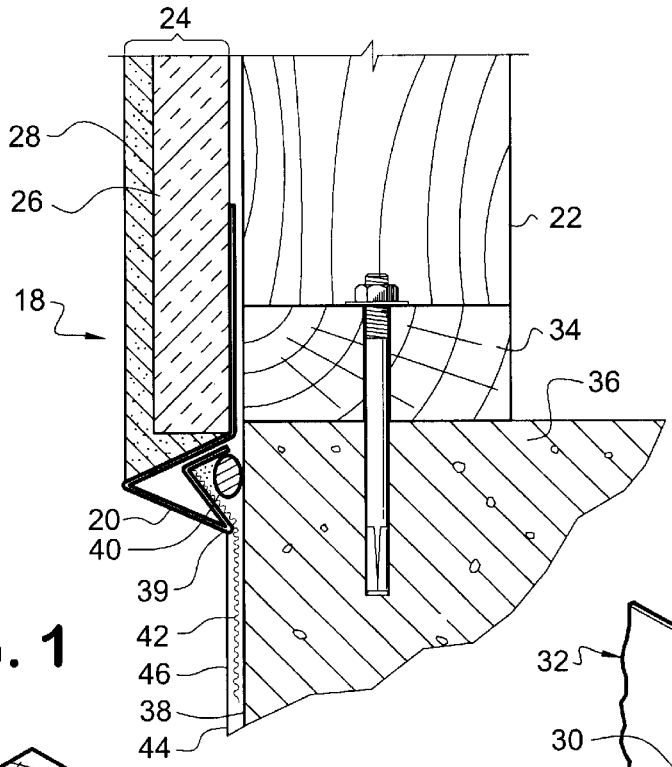
FIG. 1 is a side view, partially in section, of a preferred embodiment of the exterior wall sealing system of the present invention.
Figure 2:
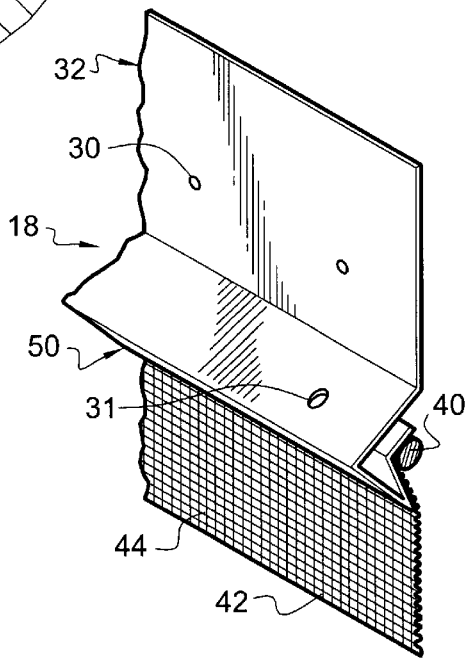
FIG. 2 is a partial perspective view illustrating an embodiment of the screed, seal and flexible sheathing of the exterior wall sealing system, according to a preferred embodiment of the present invention.

FIG. 1 is a side view, partially in section, of a preferred embodiment of the exterior wall sealing system 18 of the present invention. In the illustrated embodiment, a preferred weep screed 20 is shown in an installed position between the exterior wall framing 22 and the exterior finish system 24 (this arrangement embodying herein a screed, overlaying the base plate, structured and arranged to assist in the fastening of an exterior finish system to an exterior wall of the building). The exterior finish system 24 preferably comprises, in this embodiment, an insulation board 26, which is preferably expanded rigid polystyrene plastic, and a stucco-type coating 28. Preferably, the screed 20 is formed from galvanized metal and bent in the illustrated position; each screed is preferably several feet long, but the cross-section shown is preferably throughout. As further shown in FIG. 2 and FIG. 3, the screed 20 has nailing holes 30 along its upper portion 32. The nailing holes 30 are used to nail the screed 20 to the base plate 34. Hole 31 (and other similar holes along the length of screed 20) provide an exit path for moisture collecting above screed 20 and falling the inside of screed 20. The base plate 34 sits on the perimeter and top of the foundation 36, which is normally concrete.

Typically, the foundation 36 is slightly uneven at the edge 38. Due to this unevenness, a gap 39 may occur between the screed 20 and the foundation 36. The embodiment of the present invention provides a multiple seal system 50 (embodying herein a blocker structured and arranged to block passage of the vermin between the foundation and such screed), preferably comprising a foam seal element 40, which is preferably a one-half inch round compressive-type seal (embodying herein wherein such blocker comprises a foam seal, cooperating with such screed, and structured and arranged to prevent vermin passage between such screed and the foundation; and embodying herein wherein such foam seal comprises a round compressive seal). The multiple seal system 50 also preferably comprises a thin material layer, which is preferably a fiberglass netting 42, as shown (embodying herein wherein such blocker comprises an adhesive and a thin material layer cooperating to block the passage of the vermin). The fiberglass netting 42 preferably comprises about one-quarter-inch squares 44. The weep screed 20 and multiple seal system 50 are installed against the base plate 34 in a normal manner, such as nailing. Preferably, an adhesive sealant 46, preferably comprising 50% portland cement and 50% "Seneflex Alpha Base"™ (available from Senergy™ of Phoenix, Ariz.), is applied over the fiberglass netting 42, subsequent to the multiple seal system 50 installation, which bonds the fiberglass netting 42 to the foundation 36 and further seals the gap 39. The fiberglass netting 42 is then preferably coated with a matching stucco-type coating 28 to complete the installation.

Figure 3:
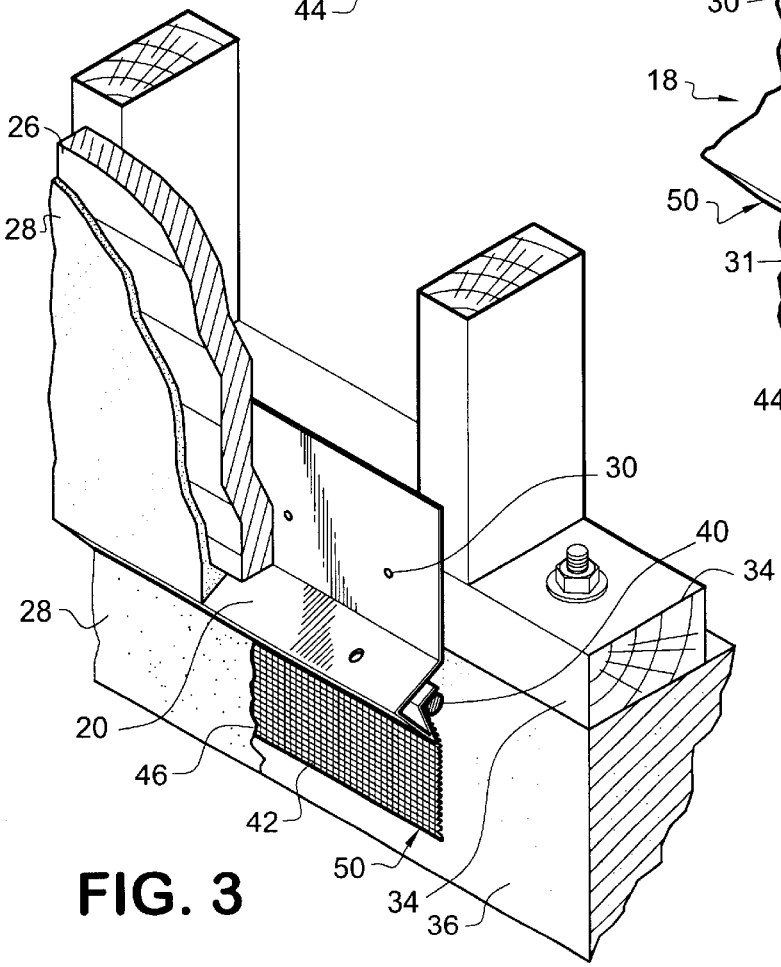
FIG. 3 is a perspective view, partially in section, of the exterior wall sealing system, according to a preferred embodiment of the present invention.
Figure 4:
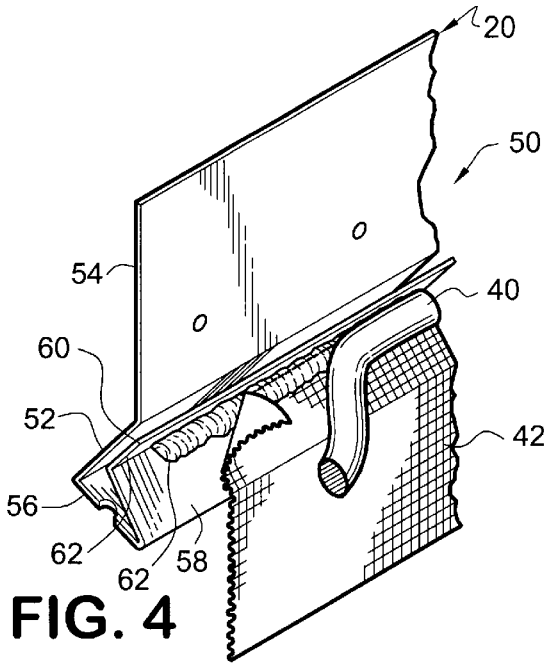
FIG. 4 is a perspective view, partially in section, of the weep screed, seal and flexible sheathing of the exterior wall sealing system, according to another preferred embodiment of the present invention.
Figure 5:
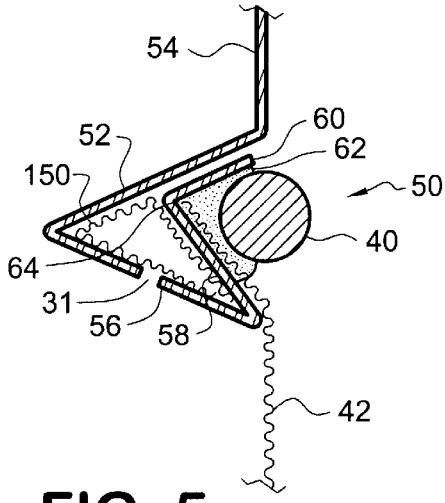
FIG. 5 is a side view, in section, of the embodiment of FIG. 4.

FIG. 4 illustrates a preferred method of assembling the multiple seal system 50. The screed 20 is preferably formed such that outward angled portion 52 protrudes downward and outward at preferably about a 45-degree angle from the vertical plane of the top portion 54 (embodying herein a planar substantially vertical upper portion, and an outward angled portion, which protrudes downward and outward from a vertical plane of such substantially vertical upper portion). Inward angled portion 56 returns downward and inward toward the vertical plane of the top portion 54 at preferably about 45 degrees from outward angled portion 52, until it is about even with the vertical plane of the top portion 54 (embodying herein an inward angled portion which returns downward and inward toward such substantially vertical upper portion until it reaches an approximate intersection with such vertical plane). The inner return outward angle portion 58 then bends and returns upward and outward in preferably about a 22-½ degree angle to that of portion 56 (embodying herein an inner return outward angle portion which returns upward and outward). Inner return inward angle portion 60 then continues in about a parallel angle to angle portion 52, as shown, extending until inward angle portion 60 reaches an approximate intersection with the vertical plane of angle portion 52 (this arrangement embodying herein an inner return inward angle portion which extends until it reaches an approximate intersection with such vertical plane). Preferably, an adhesive caulk 62 is placed along the inside crease 64, so that the fiberglass netting 42 may be adhered along the inner return outward angle portion 58, as shown (this arrangement embodying herein wherein such first and second inner return portions comprise an inwardly facing horizontal crease structured and arranged to support such foam seal). Preferably, foam seal element 40 is placed over the top of the fiberglass netting 42 and also adhered along the crease 64 by the adhesive caulk 62. Preferably, the screed 20 and multiple seal system 50 is then installed against the base plate 34, in a normal manner, such as nailing. Preferably, adhesive sealant 46 is then applied over the fiberglass netting 42, which adheres the fiberglass netting 42 to the foundation 36 and further seals the gap 39. The fiberglass netting 42 is then preferably coated with a matching stucco-type coating 28 to complete the installation, as shown in FIG. 3. FIG. 5 further illustrates the above-described relationship from a side view, in section.

Figure 6:
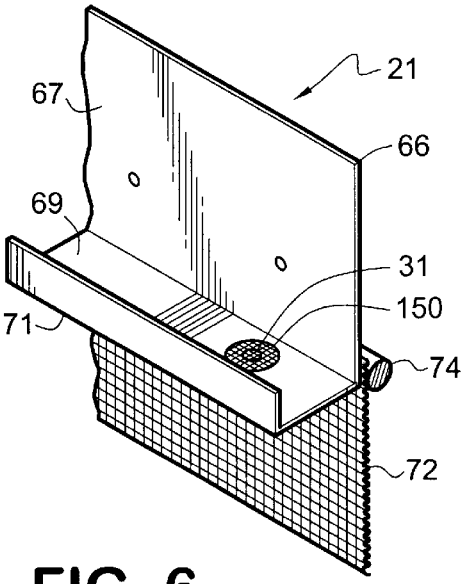
FIG. 6 is a perspective view, partially in section, of yet another embodiment of the exterior wall sealing system of the present invention.
Figure 7:
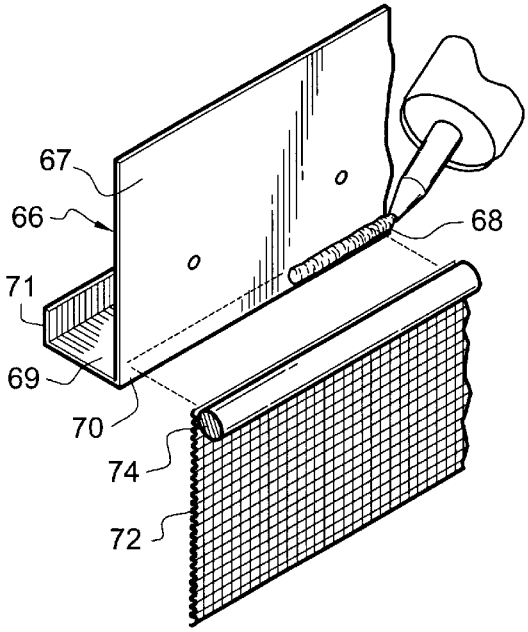
FIG. 7 is a perspective view, partially in section, of the method of applying the embodiment of FIG. 6.
Figure 8:
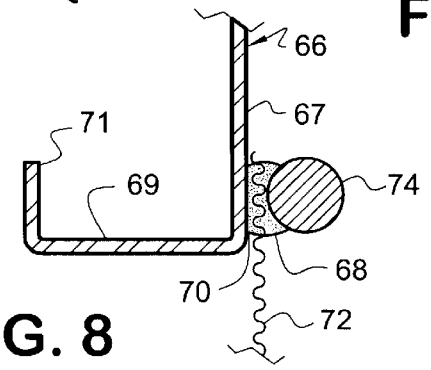
FIG. 8 is a side view, in section, of the embodiment of FIG. 7.
Figure 11:
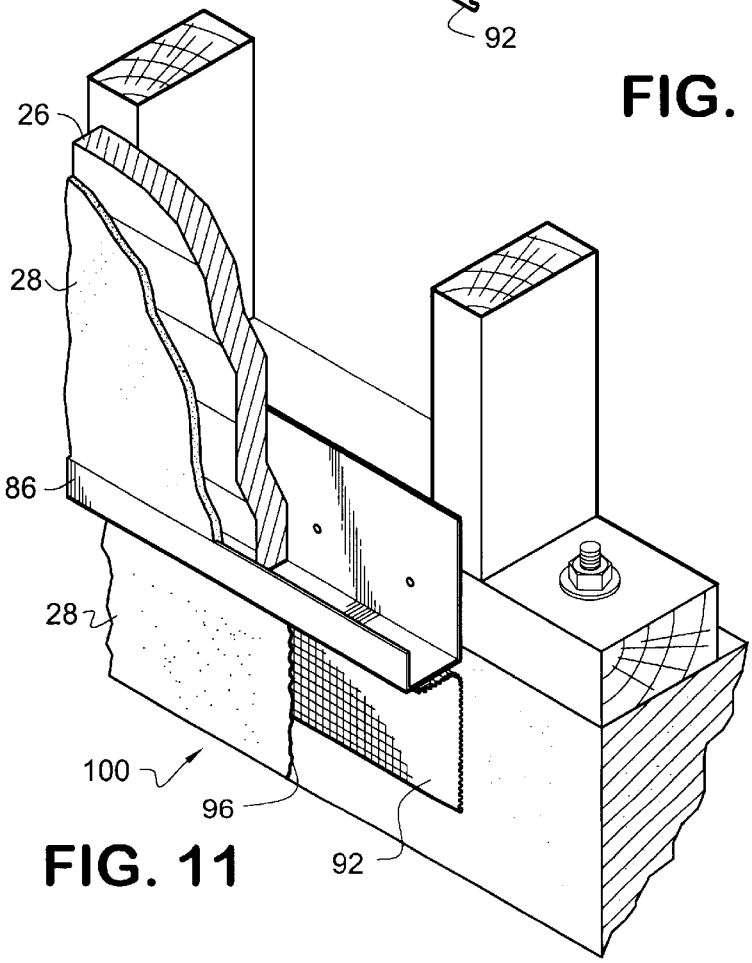
FIG. 11 is a perspective view, partially in section, of the embodiment of FIG. 10, illustrating additional steps in the application of the exterior wall sealing system of the present invention.

FIG. 6 is a perspective view, partially in section, of yet another embodiment 21 of the exterior wall sealing system of the present invention. In this embodiment, a prior art screed 66 is shown. Preferably, prior art screed 66 comprises an upper substantially vertical portion 67; and a lower substantially flat horizontal bottom portion 69; wherein such upper substantially vertical portion and such lower substantially flat horizontal bottom portion are substantially perpendicular to each other. Prior art screed 66 may also include a vertical return portion 71. FIG. 7 is a perspective view, partially in section, of the method of assembling the embodiment of FIG. 6. FIG. 8 is an enlarged partial side view, in section, of the embodiment of FIGS. 6 and 7. The illustrated embodiment is preferably designed to be attached to such prior art screeds such that the exterior wall sealing system may be utilized on such screeds. Preferably, in this embodiment, adhesive caulk 68 is applied along the bottom rear portion 70 of the screed 66. Preferably, fiberglass netting 72, similar to that described above, having one quarter inch squares 44, is placed onto the adhesive caulk 68, as shown. Preferably, a foam seal element 74, which is preferably a one-half-inch round compressive type seal is placed on top of the fiberglass netting 72 and set into the adhesive caulk 68, as shown. Such screeds 66 are typically installed along the foundation/base plate as shown in FIG. 11 (as screed 86). Preferably, upon installation, the fiberglass netting 72 is then coated with an adhesive sealant 46, such as is used with the embodiment of FIG. 1. Preferably, adhesive sealant 46 adheres the fiberglass netting 42 to the foundation 36 and further seals the gap 39. The fiberglass netting 42 is then preferably coated with a matching stucco type coating 28 to complete the installation, as with the first embodiment. Preferably, a matching stucco type coating 28 is used to complete the installation as described above in relation to FIG. 1.

Figure 9:
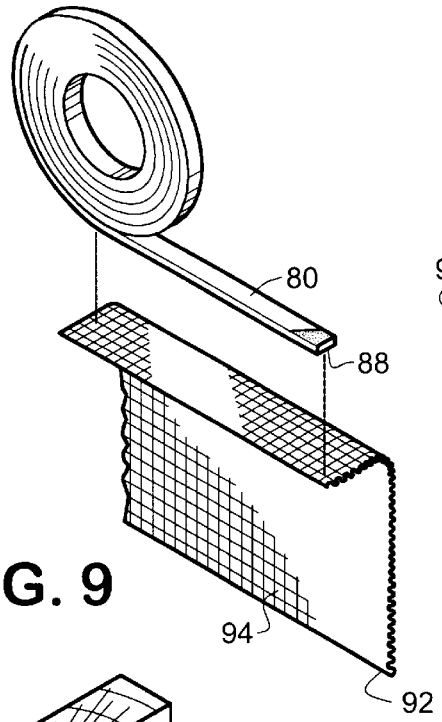
FIG. 9 is a perspective view illustrating an initial step of yet another preferred embodiment of the exterior wall sealing system of the present invention.
Figure 10:
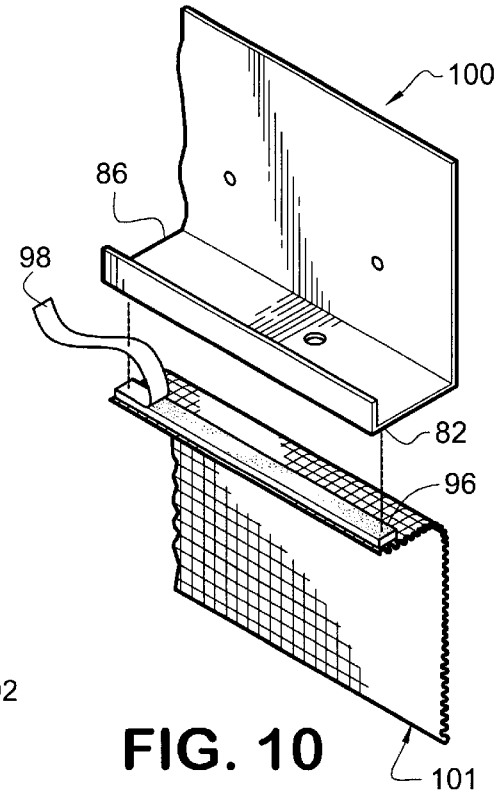
FIG. 10 is a perspective view of the embodiment of FIG. 9 illustrating a first step in the application of the embodiment of the exterior wall sealing system of the present invention.
Figure 12:
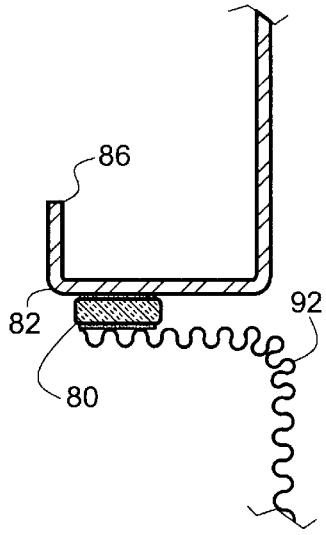
FIG. 12 is a side view, in section, of the embodiment of FIG. 10.

FIG. 9 is a perspective view of a first step in making yet another preferred embodiment 100 of the exterior wall sealing system of the present invention. FIG. 10 is a perspective view of the embodiment of FIG. 9 illustrating further steps in the making of the embodiment of the exterior wall sealing system 18 of the present invention. FIG. 11 is a perspective view, partially in section, of the embodiment of FIG. 10 illustrating additional steps in the application to the structure of the embodiment of FIG. 9 of the exterior wall sealing system of the present invention. FIG. 12 is an enlarged partial side view, in section, of the embodiment of FIG. 10.

This third illustrated embodiment 100 is preferably designed such that the exterior wall sealing system may be utilized on existing screeds which have already been installed. Preferably, in this embodiment, foam seal element 80 comprises a double-sided-adhesive-coated compressive type seal, which is preferably flat, as shown (this arrangement embodying herein such foam seal further comprises a two-sided flat compressive seal; and wherein such two-sided flat compressive seal comprises adhesive on at least one side). Preferably, fiberglass netting 92, similar to that described above, having preferably about one-quarter-inch squares 94, is attached onto one adhesive side 88 of the foam seal element 80, as shown. Preferably, the second adhesive side 96, has a contact cover sheet 98, which is removable. Preferably, the contact cover sheet 98 is removed from the second adhesive side 96 and the fiberglass netting assembly 101 is then adhesively attached along the bottom portion 82 of the existing screed 86 by attaching foam seal element 80, to which fiberglass netting assembly 101 has been attached as described (embodying herein wherein such foam seal cooperates with such adhesive and a thin material layer to block the passage of the vermin between the foundation and such screed). Such screeds 86 are typically installed along the foundation 36 and base plate 34, as shown in FIG. 11 and previously in FIG. 1 and FIG. 3. Preferably, upon installation, the fiberglass netting 92 is then coated with an adhesive sealant 46, such as is used with the embodiment of FIG. 1. Preferably, a matching stucco type coating 28 is then applied over the fiberglass netting 92 and adhesive sealant 46 (see FIG. 11) to complete the installation as described above in the first two embodiments. FIG. 12 further illustrates the installation from the side.

Figure 13:
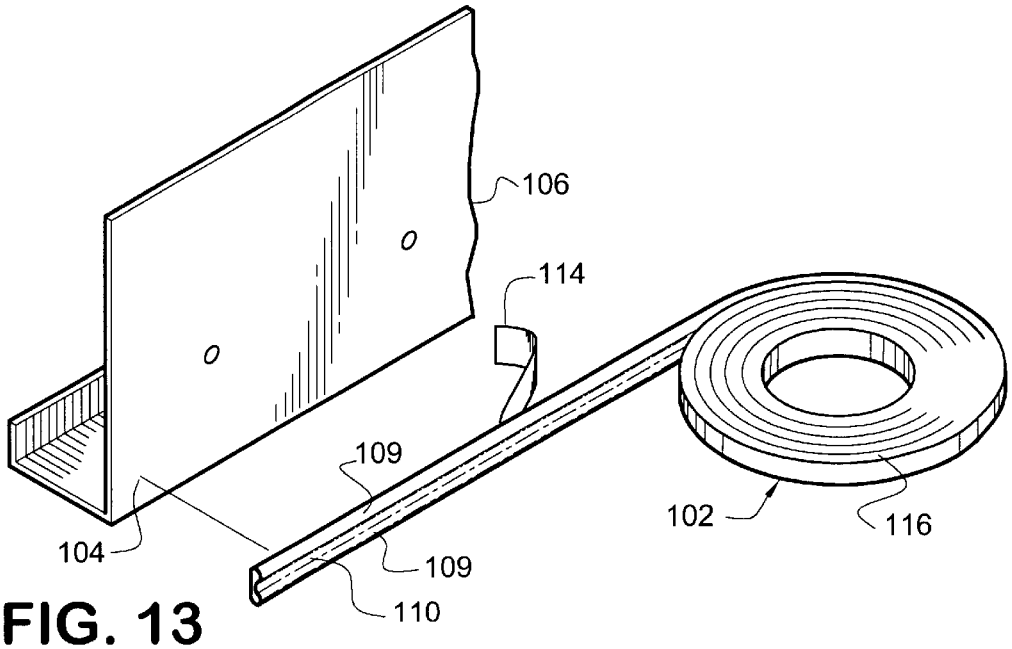
FIG. 13 is a perspective view illustrating an initial step of yet another preferred embodiment of the exterior wall sealing system of the present invention.
Figure 14:
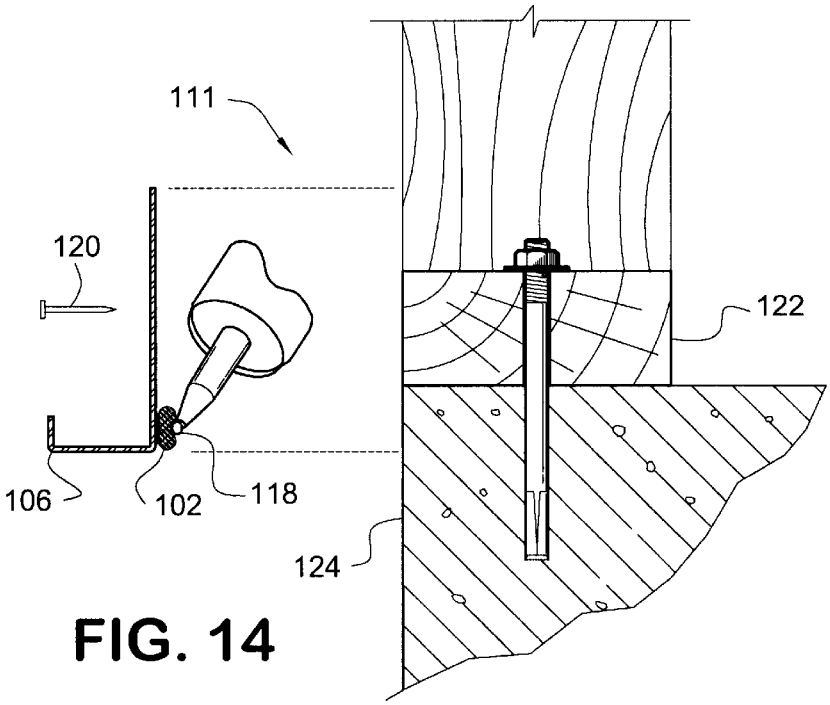
FIG. 14 is a perspective view, partially in section, of the embodiment of FIG. 13 illustrating further steps in the application of the embodiment of FIG. 13 of the exterior wall sealing system of the present invention.
Figure 15:
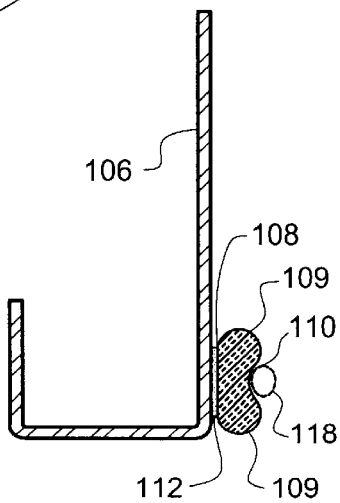
FIG. 15 is a side view, in section, of the embodiment of FIG. 14.

FIG. 13 is a perspective view of a first step in making yet another preferred embodiment 111 of the exterior wall sealing system of the present invention. FIG. 14 is a perspective view, partially in section, of the embodiment of FIG. 13 illustrating further steps in the making of the embodiment of FIG. 13. FIG. 15 is an enlarged side view, in section, of the embodiment of FIG. 14. Preferably, this embodiment is designed such that the exterior wall sealing system may be utilized on screeds which may not require or be able to utilize, under particular circumstances, the fiberglass netting portion of the above described embodiments. Such installations may include, for example, foundations where a perimeter sidewalk is poured right up to the foundation. Preferably, in this embodiment, foam seal element 102, a compressive type seal, is applied to the lower back portion 104 of the screed 106. Preferably, foam seal element 102 comprises a B-cross-section configuration structure, as shown, having one longitudinal side with a flat portion 108 and one longitudinal side with two convex portions 109 and a center concave portion 110 (this arrangement embodying herein a B-cross-section configuration compressive seal comprising a first longitudinal side with a flat portion, a second longitudinal side with two convex portions, and a center concave portion). Preferably, flat portion 108 further comprises an adhesive 112 and a removable release sheet 114 covering the adhesive (embodying herein wherein such flat portion further comprises an adhesive and a removable release sheet covering such adhesive). The foam seal element 102 is preferably manufactured in rolls 116 as shown and the removable release sheet 114 is applied at the time of manufacture of the roll 116. In installation, the release sheet 114 is removed and the flat portion 108 with the adhesive 112 is applied to the lower back portion 104 of the screed 106 (embodying herein wherein such flat portion of such B-cross-section configuration compressive seal is adhesively attached to the back of such planar substantially vertical upper portion of such screed). Preferably, a caulking bead 118 is then applied in the concave portion 110 of the foam seal element 102, as shown in FIG. 14 (embodying herein whereby a caulking bead placed in such center concave portion will assist in sealing such screed when attached to the juncture between the foundation and the base plate). The screed 106 is then attached to the building, preferably by nails 120 or screws. The screed 106 is preferably nailed into the base plate 122 such that the caulking bead 118 is between the base plate 122 and the foundation 124. In this manner, the screed 106 is preferably sealed against the foundation 124.

With reference to FIG. 5 and FIG. 6, it is noted that holes 31 ("weep holes") may be made vermin-proof by placing mosquito netting 150 over such holes 31. In FIG. 6, a small piece of mosquito netting 150 is shown adhesively placed over hole 31. In FIG. 5, is shown a long sheet of mosquito netting 150 folded to be inserted into the triangular screed section, as shown.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A system for blocking vermin from access to a building envelope in the vicinity of a juncture between a foundation and a base plate comprising:

a) a screed, overlaying the base plate, structured and arranged to assist in the fastening of an exterior finish system to an exterior wall of the building; and b) a blocker structured and arranged to block passage of the vermin between the foundation and said screed;

c) wherein said blocker comprises a compressive foam seal; and wherein said screed comprises a crease which forms a gap structured and arranged to hold said compressive foam seal between said screed and the foundation

2. The system according to claim 1 wherein said blocker further comprises an adhesive and a thin material layer cooperating with said adhesive.

3. The system according to claim 2 wherein said foam seal comprises a round compressive seal.

4. The system according to claim 1 wherein said screed comprises:

a) a planar substantially vertical upper portion;

b) an outward angled portion which protrudes downward and outward from a vertical plane of said substantially vertical upper portion;

c) an inward an led portion which returns downward and inward from said outward angled portion toward the vertical plane of said substantially vertical upper portion until said inward angled portion reaches an approximate intersection with said vertical plane;

d) an inner return outward angle portion which returns upward and outward from said inward angled portion; and e) an inner return inward angle portion which extends from said inner return outward angle portion until said inner return inward angle portion reaches an approximate intersection with said vertical plane;

f) wherein said inner return outward angle portion and said inner return inward angle portion comprises an inwardly facing horizontal crease structured and arranged to support said foam seal.

5. The system according to claim 4 wherein said foam seal further comprises:

a. a B-cross-section configuration compressive seal comprising i. a first longitudinal side with a flat portion, and ii. a second longitudinal side with two convex portions and a center concave portion, iii. wherein said flat portion further comprises an adhesive and a removable release sheet covering said adhesive, iv. wherein said flat portion of said B-cross-section configuration compressive seal is adhesively attached to the back of said planar substantially vertical upper portion of said screed, v. whereby a caulking bead placed in said center concave portion will assist in sealing said screed when attached to the juncture between the foundation and the base plate.

6. The system according to claim 4 wherein said blocker further comprises an adhesive and a thin material layer cooperating with said adhesive.

7. The system according to claim 6 wherein said foam seal comprises a round compressive seal.

8. The system according to claim 1 wherein said screed comprises:

a. an upper substantially vertical portion; and b. a lower substantially flat horizontal bottom portion;

c. wherein said upper substantially vertical portion and said lower substantially flat horizontal bottom portion are substantially perpendicular to each other.

9. The system according to claim 8 wherein said blocker further comprises an adhesive and a thin material layer cooperating with said adhesive.

10. The system according to claim 9 wherein said foam seal comprises a round compressive seal.

11. The system according to claim 9 wherein:

a. said foam seal further comprises a two-sided flat compressive seal; and b. wherein said foam seal cooperates with said adhesive and a thin material layer to block the passage of the vermin between the foundation and said screed.

12. The system according to claim 11 wherein said two-sided flat compressive seal comprises adhesive on at least one side.

13. The system according to claim 8 wherein said foam seal further comprises:

a. a B-cross-section configuration compressive seal comprising i. a first longitudinal side with a flat portion, ii. a second longitudinal side with two convex portions, and iii. a center concave portion, iv. wherein said flat portion further comprises an adhesive and a removable release sheet covering said adhesive, and v. wherein said flat portion of said B-cross-section configuration compressive seal is adhesively attached to the back of said planar substantially vertical upper portion of said screed, vi. whereby a caulking bead placed in said center concave portion will assist in sealing said screed when attached to the juncture between the foundation and the base plate.

14. The system according to claim 1 further comprising:

a. the foundation;

b. the base plate;

c. the exterior finish system; and d. at least one exterior wall of the building.

15. A system for blocking vermin from access to a building envelope in the vicinity of a juncture between a foundation and a base plate comprising:

a) a screed, overlaying the base plate, comprising i) a planar substantially vertical upper portion, ii) an outward angled portion which protrudes downward and outward from a vertical plane of said sustantially vertical upper portion, iii) an inward angled portion which returns downward and inward from said outward angled portion toward the vertical plane of said substantially vertical upper portion until said inward angled portion reaches an approximate intersection with said vertical plane, iv) an inner return outward angle portion which returns upward and outward from said inward angled portion, and v) an inner return inward angle portion which extends from said inner return outward angle portion until said inner return inward angle portion reaches an approximate intersection with said vertical plane, vi) wherein said inner return outward angle portion and said inner return inward angle portion comprises an inwardly facing horizontal crease structured and arranged to support a foam seal element; and b) an adhesive and a thin material layer cooperating to block the passage of the vermin between the foundation and said screed.

16. The system according to claim 15 further comprising the foam seal element supported by said inwardly facing horizontal crease, and cooperating with said screed and said adhesive and a thin material layer, structured and arranged to prevent vermin passage between said screed and the foundation.

17. The system according to claim 16 wherein said foam seal element comprises a round compressive seal.

18. A system for blocking vermin from access to a building envelope in the vicinity of a juncture between a foundation and a base plate comprising a) a screed comprising i) an upper substantially vertical portion, ii) a lower substantially flat horizontal bottom portion iii) wherein said upper substantially vertical portion and said lower substantially flat horizontal bottom portion are substantially perpendicular to each other;

b) an adhesive and a thin flexible material layer cooperating to block the passage of the vermin between said screed and the foundation; and c) a foam seal element, cooperating with said screed and said adhesive and a thin material, structured and arranged to prevent vermin passage between said screed and the foundation.

19. The system according to claim 18 wherein said foam seal element comprises a round compressive seal.

20. The system according to claim 18 further comprising:

a. a foam seal comprising a two-sided flat compressive seal;

b. wherein said foam seal cooperates with said adhesive and a thin material layer to block the passage of the vermin between the foundation and said screed.

* * * * *

UNITED STATES PATENT AND TRADEMARK OFFICE

CERTIFICATE OF CORRECTION

PATENT NO. : 6,591,559 B2
DATED : July 15, 2003
INVENTOR(S) : Contreras et al.

It is certified that error appears in the above-identified patent and that said Letters Patent is hereby corrected as shown below:

Column 8,
Line 20, after "foundation" insert -- . --
Line 32, "an led" should read -- angled --

Signed and Sealed this

Fourth Day of November, 2003

JAMES E. ROGAN
*Director of the United States Patent and Trademark Office*